US005103206A

United States Patent [19]

Yu

[11] Patent Number: 5,103,206

[45] Date of Patent: Apr. 7, 1992

[54] SECURITY SYSTEM

[76] Inventor: Thiann R. Yu, 958 Lalonde St., Timmins, Ontario, Canada, P4P 1B8

[21] Appl. No.: 379,615

[22] Filed: Jul. 14, 1989

[51] Int. Cl.[5] ..... G08B 29/00

[52] U.S. Cl. ..... 340/506; 340/531; 340/539; 340/533; 340/508; 340/507; 340/536

[58] Field of Search ..... 340/506, 531, 539, 508, 340/507, 533, 536

[56] References Cited

U.S. PATENT DOCUMENTS

| | | | |
|---|---|---|---|
| 3,133,276 | 5/1964 | Miller et al. | 340/517 |
| 3,909,826 | 9/1975 | Schildmeier et al. | 340/539 |
| 4,019,139 | 4/1977 | Ortega | 340/539 |
| 4,660,023 | 4/1987 | Thern et al. | 340/531 |
| 4,673,920 | 6/1987 | Ferguson et al. | 340/531 |
| 4,812,820 | 3/1989 | Chatwin | 390/531 |

*Primary Examiner*—Donnie L. Crosland

[57] ABSTRACT

A security system including a plurality of alarm equipped security units usable at discrete locations and operated by individual power sources at those discrete locations. The units are interconnected and alarm linked with one another with the system being set up such that disruption of the interconnection between units at any location in the system causes alarm operation at all of the alarm linked security units.

3 Claims, 4 Drawing Sheets

SECURITY SYSTEM

FIELD OF THE INVENTION

The present invention provides a security system incorporating a plurality of individual security units usable at different locations. The units are interconnected such that distruption of the interconnection activates all of the units making the system particularly suited for neighborhood surveillance and the like.

BACKGROUND OF THE INVENTION

In view of ever increasing crime rates there has been very strong interest in community or neighborhood watch programs. These watch programs can also be used to monitor environmental associated problems when one is absent from ones home and having the neighbor drop in to check in on potential problems such as frozen pipes, flooding, etcetera.

The normal method of providing a neighborhood watch is by having one's neighbor either physically watch one's home or, as noted above, actually visiting and checking the home when one is on holidays.

Although the description immediately above relates to watch systems being provided in a neighborhood community, it will be appreciated that different types of watch systems are also required in industrial and other areas.

SUMMARY OF THE PRESENT INVENTION

The present invention provides a security system specifically designed to avoid the requirement of having to physically watch or monitor different community areas. In particular, the security system of the present invention comprises a plurality of alarm equipped security units usable at discrete locations and operated by individual power units at those discrete locations. The units are interconnected by connecting meansand settable between a link mode and amono mode with the system being set up such that disruption of the connecting means at any location in the system causes alarm operation at all of the security units set in the link mode. Therefore, the security system of the present invention not only provides a remote monitoring of different locations but in addition allows that monitoring to be carried out at more than one location.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
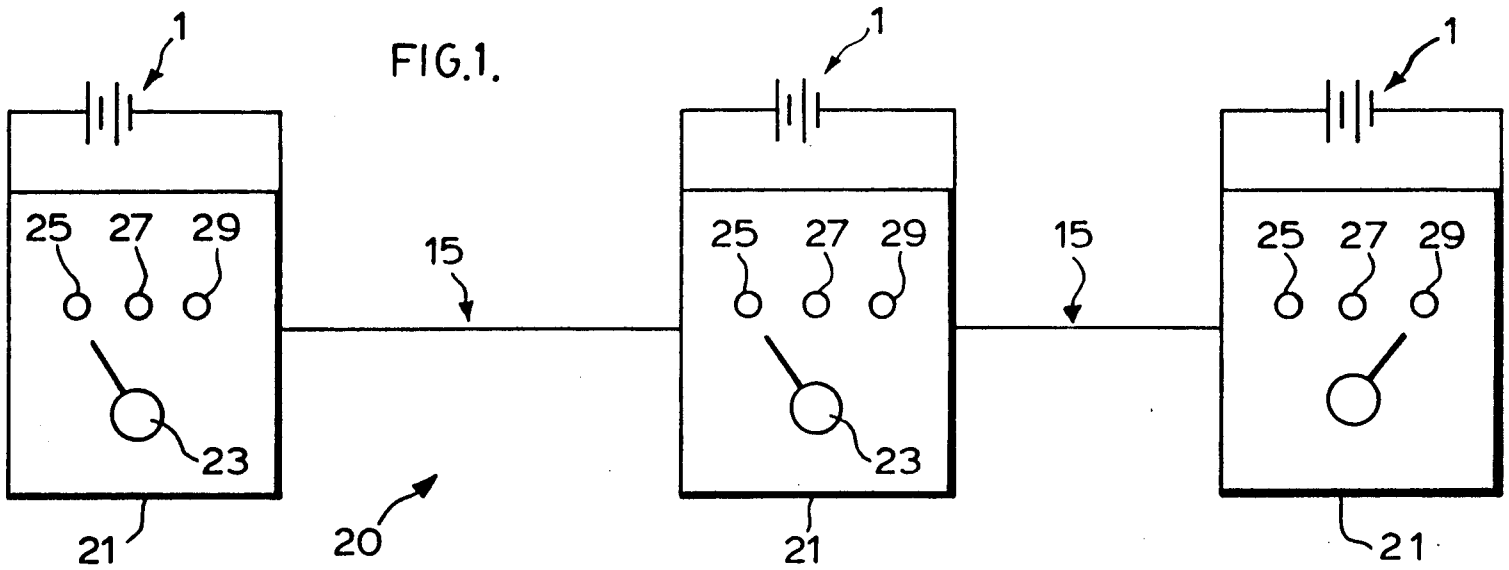
FIG. 1 is a schematic view of a security system according to a preferred embodiment of the present invention.

FIG. 1 shows a security system generally indicated at 20. This security system is made up of a plurality of individual security units 21. Preferably all of these units are made indentical to one another.

In the preferred set up of the present invention all of the security units 21 are placed at discrete locations relative to one another. The security system is particularly suitable as a neighborhood monitor where each of the units 21 is placed in a different home. Although FIG. 1 only shows three units, it is to be appreciated that the system could incorporate as few as two units and could also incorporate many more than the three units shown.

Figure 2:
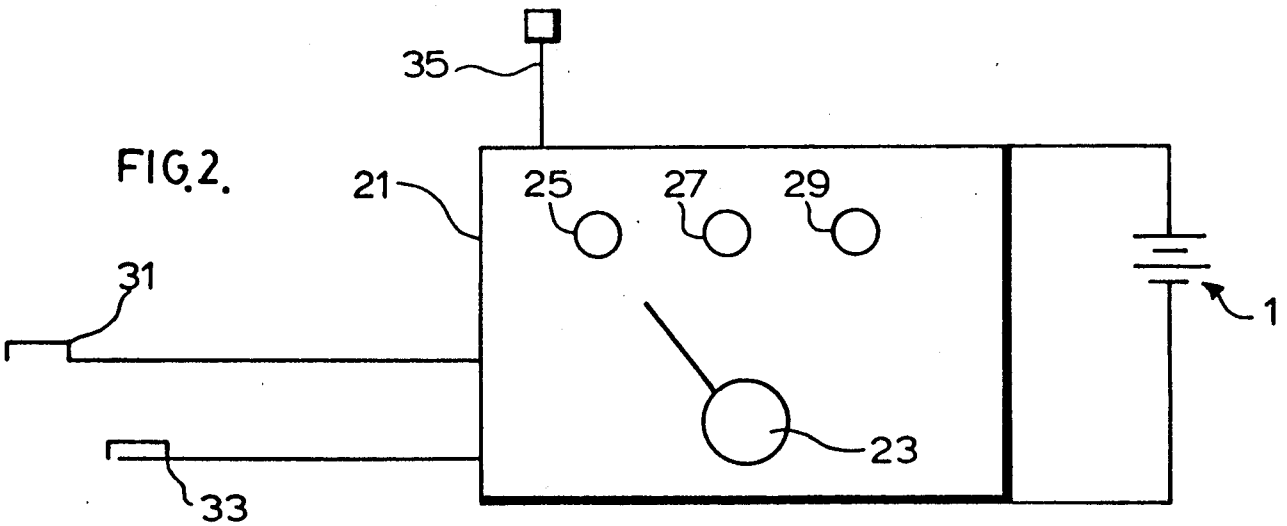
FIG. 2 is an enlarged schematic view of one of the individual security units from the system of FIG. 1.
Figure 3:
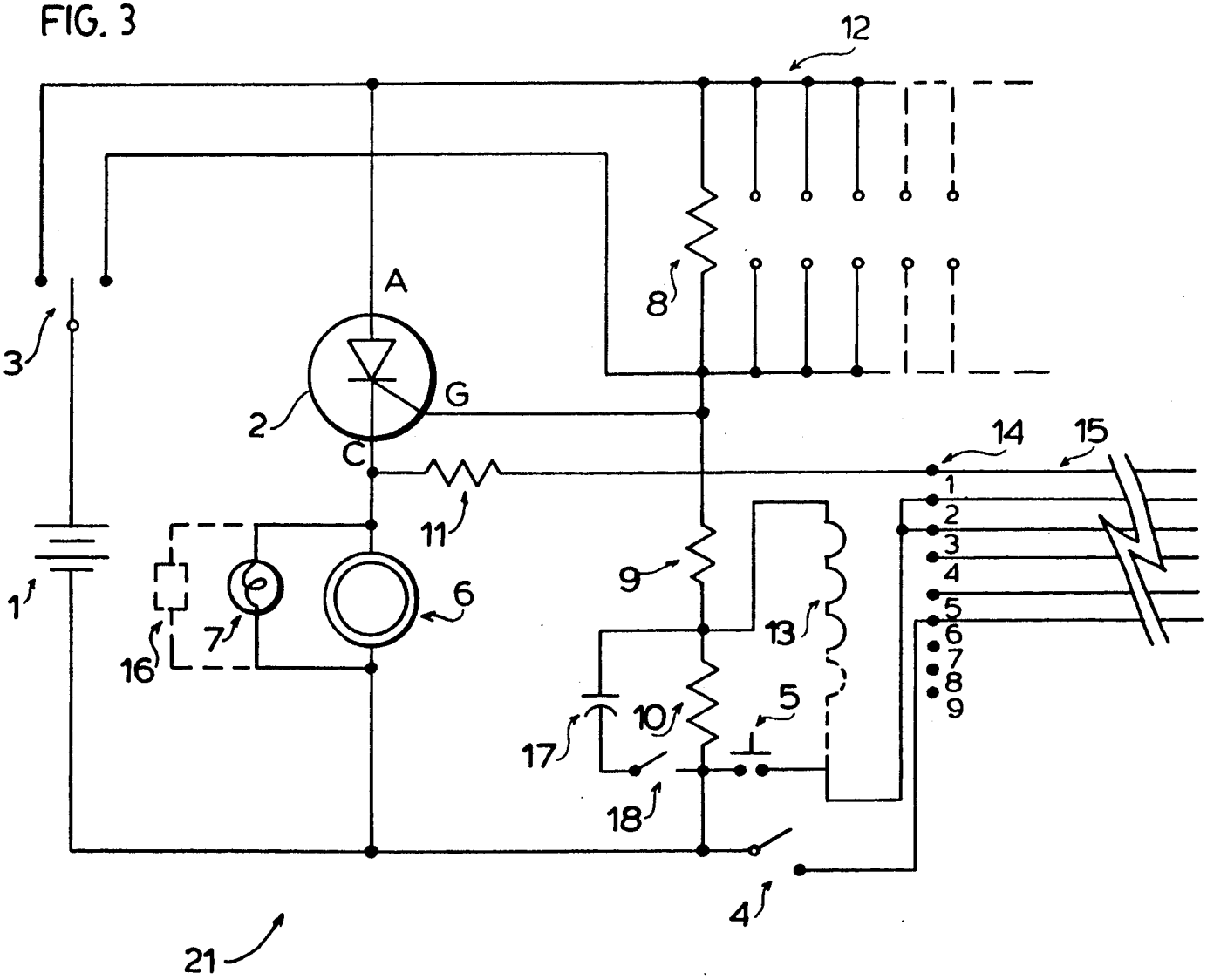
FIG. 3 is a circuit diagram for the circuitry from the security unit shown in FIG. 2.

As shown in FIGS. 1, 2 and 3 of the drawings, each of the units 21 has its own power source 1. This means that the units are operated independently of one another. However, on the other hand, all of the units are interconnected with one another by connecting means such as for example, connecting cord 15. This connecting cord runs from one unit to the next. Therefore, all of the units are interconnected through one another where, for example in FIG. 1, the two outside units are connected to one another through the center unit which is in turn connected to each of the outside units. Furthermore, all of the units have a link setting where they are alarm linked with one another.

Figure 1A:
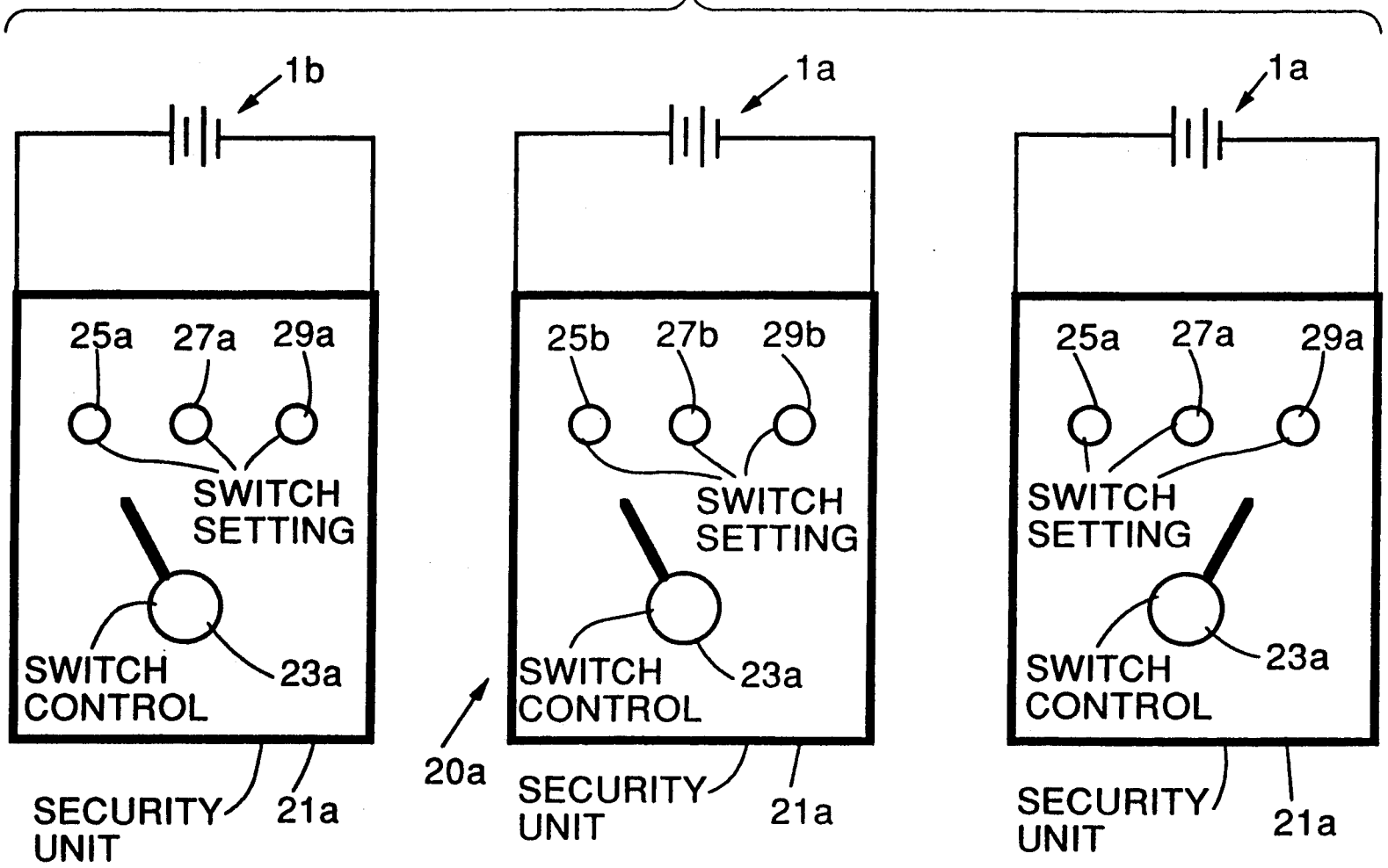
FIG. 1A is a schematic view of a security system according to a further preferred embodiment of the present invention.

FIG. 1A of the drawings shows a system generally indicated at 20*a*. This system is similar to the system shown in FIG. 1 of the drawings except that it includes a plurality of units 21*a* which are not interconnected by a physical linking but rather are interconnected in a wireless fashion.

The interconnection and alarm linking of all of the units is a key feature to the present invention, in as much as disruption of the connecting means between any two units is alarm indicated by all of the units alarm linked with one another in the system. As will be described later in detail, each of the units is provided with its own alarm and the alarms at all of the alarm linked units are activated by disruption of the connecting means between any two units. The units can also be set in a mono setting and if the connecting means between a link alarm set unit and a mono set unit is disrupted, the mono set unit will not sound an alarm but the link set unit as well as any other link set unit will sound an alarm.

By way of example, in FIG. 1, the units to the center and left side are set in a link setting or mode while the unit to the right side is set in the mono setting or mode. If the connecting means is disrupted between any of the units, then the center and left unit will sound an alarm. The right hand unit will not sound an alarm.

FIG. 1 shows connection 15 in the form of a physical connection between units 21. In a further preferred embodiment of the present invention, the interconnection between the units is made in a wireless fashion, such as for example a simple transmitter built into the circuit and sending a tone signal which would be picked up by a receiver tuned into the transmitter frequency when the system is triggered on.

Regardless of whether the system is set up as wired or wireless, it provides substantial benefits particularly as a neighborhood watch against unauthorized entry to an individual home. For example, if a burgular was to first disrupt the connecting means and then enter any of the homes, all other homes in the link mode on the system would immediately be aware of the intrusion.

FIG. 2 of the drawings shows one of the units 21 in somewhat greater detail. This particular unit includes its own DC power source 1. However, the unit could equally as well be operated by an AC power source.

Unit 21 includes a manual switch control 23 which is movable between three settings 25, 27 and 29. These settings include the link mode 25, the mono-mode 29 and a test mode 27 for the unit as to be described later in greater detail.

Also provided on unit 21 are a plurality of environmental sensors 31, 33 and 35. These environmental sensors include but are not limited to normally open switch contacts such as switch 31, bi-metal contacts, such as contact 33 and normally closed contacts such as contacts 35. Each of these sensors is specifically set to sense specific different environmental conditions which will also be described later in greater detail.

The wireless units 21*a* shown in FIG. 1*a*, have substantially the same components as the earlier described units 21. More particularly, each of the units 21*a* includes its own DC power source 1*a* and a manual switch control 23*a* which is movable between a link mode setting 25*a*, a mono-mode setting 29*a* and a test mode setting 27*a*.

FIG. 3 shows a specific circuit set up which, as noted above, includes a DC battery 1 in the range of six (6) to twelve (12) volts which powers a silicon control rectifier (SCR) 2. The cathode of the SCR 2 connects an audio alarm 6, and a flashing lamp 7 in parallel with the alarm to provide a repetitive audio tone for attracting attention to the alarm.

The circuit also includes resistors 8, 9 and 10 in the form of voltage dividers and current limiters which regulate the voltage at the gate of SCR 2 to a point lower than the trigger voltage when the resistor 10 is connected in a closed circuit with a plurality of sensors 13 and a reset switch 5. However, if any one of the sensors 13 is open, the voltage at the gate will be high enough to trigger on the SCR 2 for electric current to flow through the alarm 6 and the flashing lamp 7 thereby providing both an audio and a visual warning signal.

The sensors 13 may be in the form of door/window contact switches, as for example, switch 35 which is normally closed and which would be opened by opening the window. The sensors 13 could also be in the form of conducting foil for warning of unauthorized opening or breakage of the windows, heat sensors for fire warning, as for example the bi-metal contact of switch 33, photo resistors or infrared sensors for smoke or intruders. As a further alternative, sensors 13 can be in the form of normally closed switches installed in a pressure mat for sensing weight of an intruder entering through a door.

A group of contact sensors 12 are connected in parallel with resistor 8 to detect any continuity by providing a high gate voltage to trigger on the SCR 2. The sensors 12 may consist of water and flood sensors which would be in the form of a normally open switch such as switch 31 and which would then be closed by the flow of water across the switch. Sensors 12 may also be heat and freeze up sensors or even normally open switches installed in a door mat for sensing an intruder. Once the SCR 2 is triggered on, the current will flow through the anode and cathode with very low resistance to turn on the warning devices which will remain on even if the gate voltage of the SCR 2 is reduced below the gate trigger voltage by restoring the sensors 12 or 13.

The connecting means 15, as described above, is shown in greater detail in FIGS. 4 and 5. According to this specific embodiment, the cord consists of six (6) conductors for linkage purposes with another unit, and eight (8) conductors for linkage with other two units. The configuration of the conductors is such that if cord 15 is cut off, loop 13 becomes an open circuit which in turn triggers on the SCR 2.

A two (2) pole five position rotary switch 3, 4 is used to select the operating mode of each of the individual units 21. This switch 3, 4 is controlled by the exterior manual switch control 23 described above. As also described above, switch control 23 is settable to link, mono and test modes. The switch is in an off position between any one of these modes.

In the link mode, the environmental sensors at each of the individual units are sensed by all other units also set in the link mode. Again, by way of example if unit 21 to the left hand side of FIG. 1 is set in a link mode, and both of the other units are also set in a link mode, then any alarm set off by the environmental sensors at unit 21 on the left hand side of FIG. 1 will also set off an alarm at the other two units.

In another example, if unit 21 to the left hand side of FIG. 1 is set in a link mode and the center unit 21 is also set in a link mode, but the right hand unit is not set in a link mode, then any environmental sensor alarms at either of the left or center units will be sounded at both of these units. However, because the unit to the right hand side of FIG. 1 is set in a mono-mode, there will be no alarm signal at this particular unit from the environmental sensors at the other two units. Also, any alarm signal at unit 21 to the right hand side of FIG. 1 set in the mono mode will not be carried to the other two units. Therefore, any unit set in a mono-mode is from an environmental sensor standpoint, isolated from all the other units in the system. However, it is to be noted that by setting any of the units in the mono-mode, this still does not shut off the alarms that would be activated at all of the units in the link mode if the connecting means between any of the units, including the mono set unit, is disrupted.

Returning to FIG. 3, the operation of the alarm itself is controlled by a capacitor 17 which delays triggering on the SCR 2 to activate the audio alarm 6 and the flashing lamp 7. The size of capacitance decides the delay time. A toggle switch 18 is used to engage or disengage the capacitor 17 for delay function.

A radio transmitter 16 can be built into the circuitry for remote monitoring by means of a radio receiver or a walki-talki type set up.

In operation for testing the battery voltage or proper function of the device, the control knob 23 is simply set to the test position 27 to trigger the alarm without interfering with the other units. The reset switch should be pressed while turning the knob to the link mode to prevent triggering on any linked alarms. The delay triggering facility is to ensure that the alarm will not sound immediately if an alarmed door is opened or an alarmed pressure mat is stepped on when the home owner is leaving or entering the home.

Figure 4:
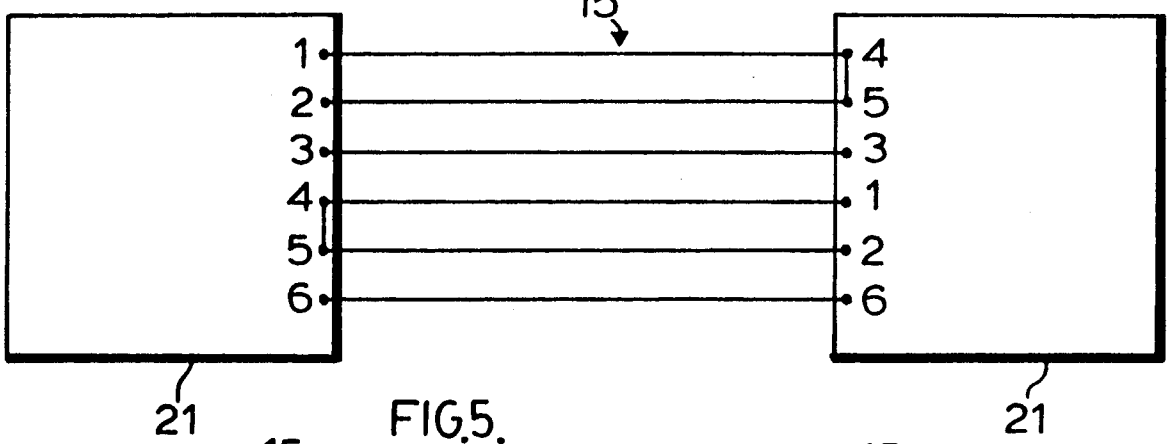
FIG. 4 is a physical interconnection diagram of two security units from the system of FIG. 1.
Figure 5:
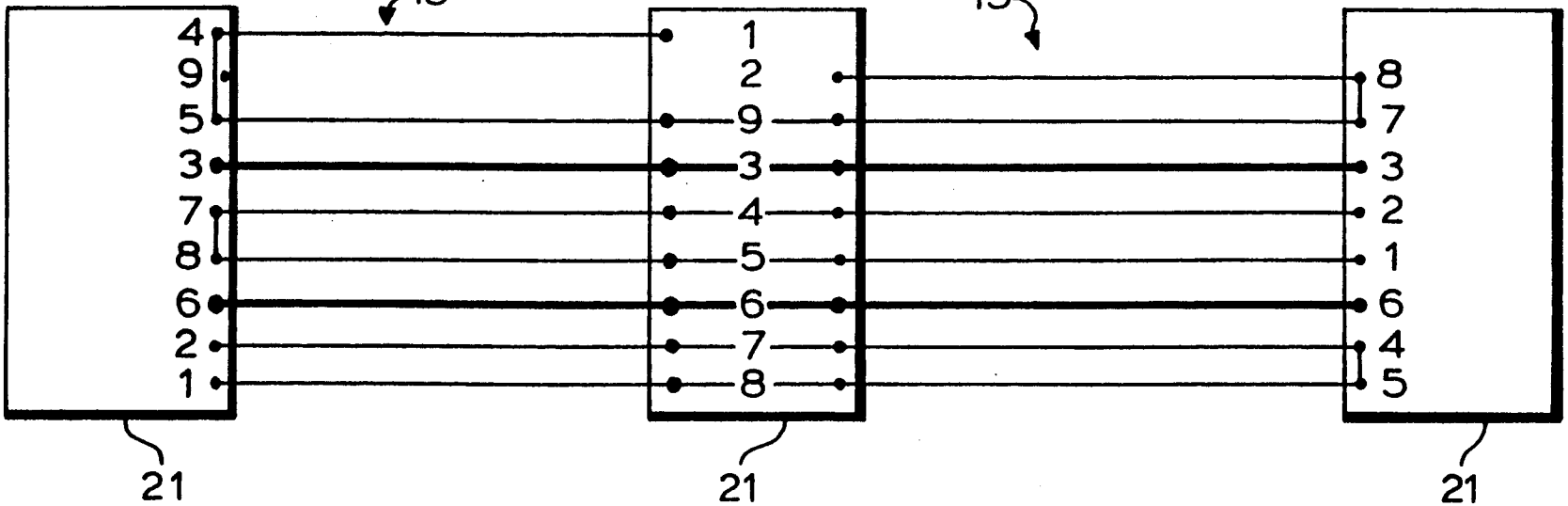
FIG. 5 is a physical interconnection diagram of three security units shown in FIG. 1.

FIG. 5 shows that the interconnection of the three units 21 uses a total of eight conductors for the cross linking of all units with one another. In FIG. 4 however, only two units 21*a* are interconnected with on another, i.e. is a two unit system in which only six conductors are linked between the two units. These two figures show typical wiring set-ups in accordance with preferred embodiments of the present invention.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A security system comprising a plurality of alarm equipped security units useable at discrete locations and operated by individual power sources at such discrete locations, said system having linking means for linking all of said units with one another and each unit having at least one environmental sensor and each unit being settable in either one of a link mode or a mono-mode and said system operating such that regardless of the mode in which any of said units is set, an alarm is indicated at all of said units set in said link mode in the event of a disruption of said linking means or activation of the environmental sensor of any unit in said system while at the same time an alarm set off by the environmental sensor at any unit set in said mono-mode is isolated from all other units in said system.

2. A security system as claimed in claim 1, including wireless linking means for linking said units in said system with one another.

3. A security system as claimed in claim 2, including a wireless radio transmitter and receiver combination linking said units in said system.

* * * * *